US008371280B2

(12) United States Patent
Vanek

(10) Patent No.: US 8,371,280 B2
(45) Date of Patent: Feb. 12, 2013

(54) BREECHLOADING TOY/SPORTING RING AIRFOIL LAUNCHER AND PROJECTILE THEREFOR

(76) Inventor: Chester Vanek, Sunnyvale, CA (US)

( * ) Notice: Subject to any disclaimer, the term of this patent is extended or adjusted under 35 U.S.C. 154(b) by 276 days.

(21) Appl. No.: 12/767,379

(22) Filed: Apr. 26, 2010

(65) Prior Publication Data

US 2010/0282227 A1 Nov. 11, 2010

Related U.S. Application Data

(60) Provisional application No. 61/215,672, filed on May 8, 2009.

(51) Int. Cl.
*F41B 7/00* (2006.01)

(52) U.S. Cl. ..... 124/16; 124/81

(58) Field of Classification Search ..... 124/16, 124/17, 20.1, 81

See application file for complete search history.

(56) References Cited

U.S. PATENT DOCUMENTS

| | | | |
|---|---|---|---|
| 3,740,884 | A | 6/1973 | Wilhelm |
| 3,815,271 | A | 6/1974 | Lynn |
| 3,877,383 | A | 4/1975 | Flatau |
| 3,898,932 | A | 8/1975 | Flatau et al. |
| 3,919,799 | A | 11/1975 | Austin et al. |
| 3,951,070 | A | 4/1976 | Flatau et al. |
| 3,980,023 | A | 9/1976 | Misevich |
| 3,982,489 | A | 9/1976 | Flatau et al. |
| 4,019,424 | A | 4/1977 | Reynolds |
| 4,022,103 | A | 5/1977 | Schmidt |
| 4,154,012 | A | 5/1979 | Miller |
| 4,190,476 | A | 2/1980 | Flatau et al. |
| 4,212,244 | A | 7/1980 | Flatau |
| 4,270,293 | A | 6/1981 | Plumer et al. |
| 4,296,564 | A | 10/1981 | Oberst |
| 4,301,736 | A | 11/1981 | Flatau et al. |
| 4,337,911 | A | 7/1982 | Flatau |
| 4,497,239 | A | 2/1985 | Curry |
| 4,527,459 | A | 7/1985 | Childers |
| 4,539,911 | A | 9/1985 | Flatau |
| 4,753,152 | A | 6/1988 | Baechler |
| 5,235,769 | A | 8/1993 | Stead et al. |
| 5,239,911 | A | 8/1993 | Ostor |
| 5,367,810 | A | 11/1994 | Stead et al. |
| 5,515,787 | A | 5/1996 | Middleton |
| 5,970,970 | A | 10/1999 | Vanek et al. |
| 6,101,919 | A | 8/2000 | Murello |
| 6,599,161 | B2 | 7/2003 | Hunter |
| 6,647,890 | B2 | 11/2003 | Findlay |
| 6,671,989 | B2 | 1/2004 | Vanek et al. |
| 6,742,509 | B2 | 6/2004 | Hunter et al. |
| 7,007,424 | B2 | 3/2006 | Vanek et al. |

*Primary Examiner* — John Ricci
(74) *Attorney, Agent, or Firm* — Weide & Miller, Ltd.

(57) ABSTRACT

A multi-shot ring airfoil launcher comprises a launcher configured to receive a magazine which supports at least two ring airfoils. The launcher includes a barrel. A chuck is mounted in the barrel and is configured to propel a ring airfoil from a breech to the muzzle of the barrel, launching a ring airfoil with forward velocity and spin. The magazine is configured to deliver successive ring airfoils to the breech or rear end of the chuck for launching. The launcher includes a cocking mechanism for loading ring airfoils on to the chuck and cocking the chuck, and a firing mechanism for firing the launcher.

18 Claims, 4 Drawing Sheets

BREECHLOADING TOY/SPORTING RING AIRFOIL LAUNCHER AND PROJECTILE THEREFOR

RELATED APPLICATION DATA

This application claims priority to U.S. Provisional Patent Application Ser. No. 61/215,672, filed May 8, 2009.

FIELD OF THE INVENTION

This invention relates to ring airfoils and ring airfoil launchers.

BACKGROUND OF THE INVENTION

Ring airfoils have a variety of desireable characteristics. Properly launched, these toy projectiles combine the characteristics of a glider with those of a ballistic object. They fly a straight, predictable path, but make use of air to glide as well. The result is a projectile with an anomalously long range, typically three times as long as a purely ballistic object having the same mass, energy, and drag. As a result, various ring airfoil toys have been developed. For example, U.S. Pat. No. 5,970,970 discloses a launcher mechanism for small ring airfoils (RAFs) made of elastomer or foam. These toys allowed players to launch RAFs far beyond the range of foam darts, balls, or equivalent ballistic toy projectiles. The first time one sees this projectile in flight, a sense of wonderment ensues at how it appears to defy normal ballistic expectations and fly so much farther.

A significant drawback to existing ring airfoil launching toys, such as that disclosed in the '970 Patent, is that they are generally configured to only launch a single ring airfoil between each manual loading. For example, the launcher detailed in the '970 Patent is a "muzzle-loader," meaning that the user is required to hand load each projectile at the muzzle, then cock and fire the launcher. While this is acceptable for "sniping" in children's war games, it means that when attacked, the child armed with this toy will not have the ability to deliver follow-on shots as is common with the multiple-barrel foam dart launchers on the market.

Some attempts have been made to develop launchers configured to launch multiple ring airfoils. For example, U.S. Pat. Nos. 6,152,123 and 6,076,511 detail two different solutions. The former device defines two independent launching mechanisms, which adds cost to the toy as well as creating a toy which is heavier and larger and has an ungainly appearance. The latter device was a launcher with a magazine. However, this device required the launch engine to be fully retracted into the frame as a unit, then pushed forward to allow indexing of the magazine, then followed by the push-through of the mechanism's member to seat a fresh RAF and cock the launcher. This repeating mechanism was costly and prone to difficult jams because of an inherent flaw in the working concept—RAFs had to be inserted into the revolving magazine from the front so they could be picked up and pushed forward by the moving launch engine. This meant that the RAFs could be held in the magazine only by friction until properly seated in the engine chuck. Yet a snug fit was also required on the chuck to keep the RAF from falling off. This required a difficult accounting of frictional forces, in which the increasing friction between the inner surface of the RAF and the chuck of the engine must be kept below the static friction holding the RAF in the magazine until the RAF has been fully seated in the chuck. Thus as the chuck of the engine moved forward to strip a RAF from the magazine, it could be prematurely pushed forward and cock sideways in the mechanism. This would cause jams nearly impossible to clear.

The need thus exists for a better ring airfoil launcher, and particularly such a launcher with a semi-automatic loading mode.

SUMMARY OF THE INVENTION

One aspect of the invention is a ring airfoil launcher. Another invention is an improved ring airfoil.

In one embodiment, a ring airfoil launcher is configured to launch successive ring airfoils in semi-automatic (i.e. without intervening manual loading) fashion. In one configuration, the launcher comprises a barrel defining a launch passage, the barrel having a first breech end and an opposing second muzzle end. A chuck is movably mounted in the passage of the barrel, the chuck having an outer surface and having a front end facing towards the muzzle end of the barrel and an opposing rear or breech end, the chuck configured to receive a ring airfoil for launching from the rear end thereof and to launch the ring airfoil from the front end thereof. At least one ring airfoil engaging member is configured to engage a ring airfoil to secure it to the chuck for launching thereof, the at least one ring airfoil engaging member configured to prevent rearward movement of a ring airfoil mounted to the chuck during propulsion of the chuck during launch. The launcher further comprises a firing mechanism configured to receive user input to cause a propulsion mechanism to propel the chuck and ring airfoil associated therewith from a cocked position in which the chuck is located at the breech end of the barrel towards second muzzle end, whereby the ring airfoil is projected off of the chuck from the front end thereof and out of the muzzle end of the barrel.

In a preferred embodiment, the launcher is configured with or configured to receive at least one magazine. The magazine is preferably capable of holding at least two ring airfoils, whereby those ring airfoils may be delivered to the chuck for successive launching.

In one embodiment, the magazine may comprise a linear magazine. The magazine may have a body configured to receive the ring airfoils and a follower configured to drive the ring airfoils to the chuck. The launcher may be configured to receive the magazine at the breech end of the barrel, whereby the ring airfoils are breech-loaded.

In another embodiment, the magazine comprises a rotary magazine. The magazine defines at least two ring airfoil mounts. The magazine is configured to rotate about an axis which is transverse to an axis through the barrel of the launcher. The magazine may be rotated about its axis to positions where the mounts align with the chuck, permitting the ring airfoils to be delivered to the chuck.

The launcher may include a cocking mechanism. The cocking mechanism is configured to move the chuck to its cocked position and to cause a ring airfoil to be delivered from the magazine to the chuck. A user may repeatedly cock and fire the launcher using the cocking and firing mechanism in order to launch ring airfoils in succession, without the need to manually load the ring airfoils between launchings.

Another embodiment is a ring airfoil. The ring airfoil defines a groove or slot for receiving a ring airfoil engaging member of the launcher. In one embodiment, the ring airfoil has a head section and a tail section and a central passage. The groove or slot is defined at an exterior of the ring airfoil, preferably at the tail section. The groove may be defined when a flap portion of the tail section is moved or pushed inwardly.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a ring airfoil launcher. Another embodiment of the invention is an improved ring airfoil. The improved ring airfoil has particular utility to the ring airfoil launcher of the invention, but might be used in other environments.

Figure 1:
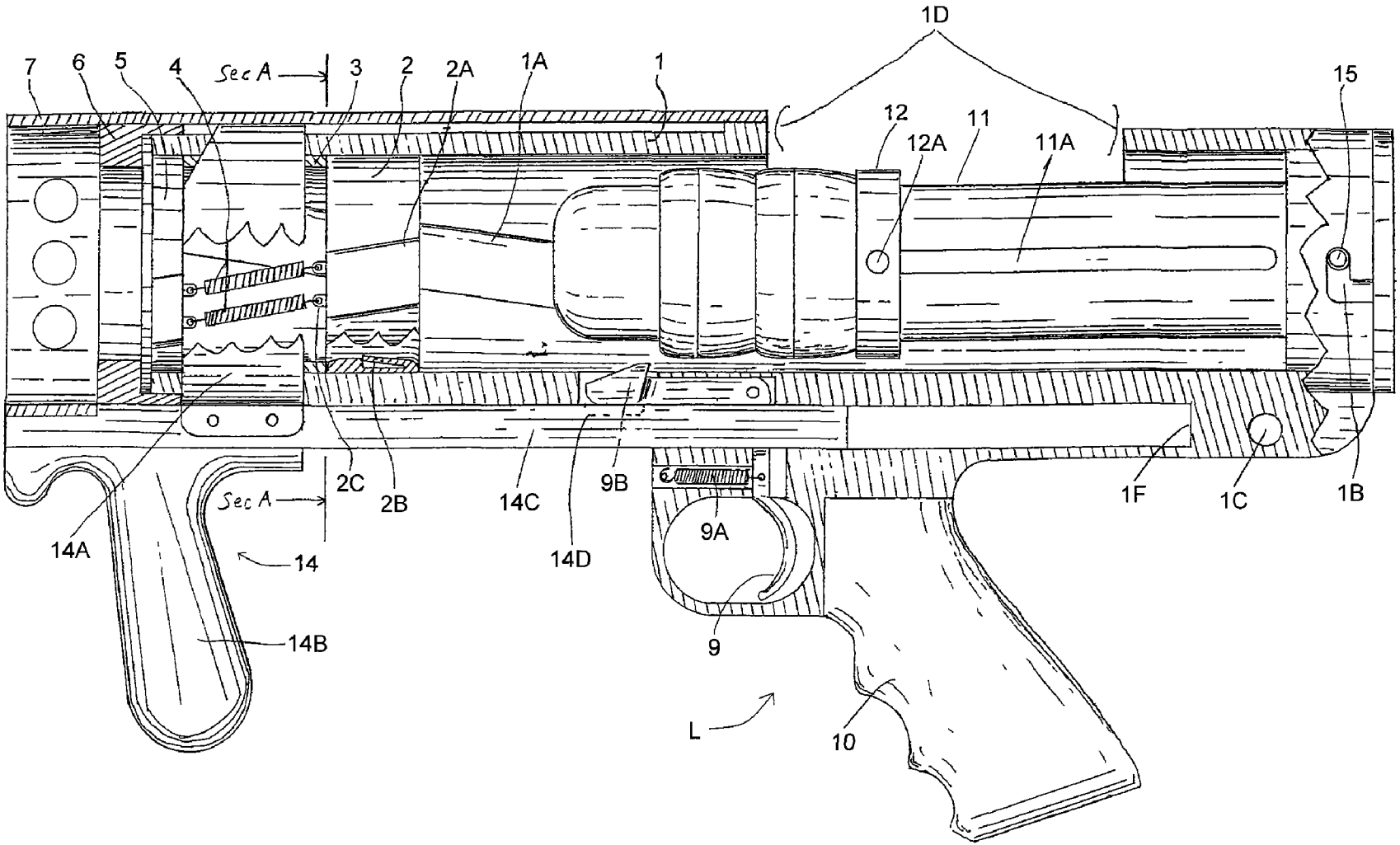
FIG. 1 is a partial section drawing of a ring airfoil launcher of the invention wherein the launcher is in a "fired" state.

An embodiment of a ring airfoil launcher (L) will now be described. Referring to FIG. 1, the launcher (L) has a barrel (1) and a ring airfoil (RAF) launch holder or chuck (2). The barrel (1) has a first or breech end and an opposing second or muzzle end. The barrel (1) defines a passage there through from end to end. The chuck (2) is preferably located in the barrel (1) and is configured to move from a cocked position at the breech end of the barrel (1) to a fired position at the muzzle end of the barrel.

FIG. 1 illustrates the chuck (2) in a forward or fired position, in which it abuts a forward stop buffer (3). The forward stop buffer (3) may comprise an annular rubber member that is configured to be impacted by a leading edge of the chuck (2) upon completion of firing.

In a preferred embodiment, the launcher (L) is configured to launch a RAF with forward velocity and rotation or spin. To this end, as detailed below, the chuck (2) is configured to both be moved forward from the cocked to the fired position by a propulsion mechanism, but to rotate (and thus cause a RAF thereon to rotate as well). To impart rotation to the chuck (2), the barrel (1) preferably includes one or more helical slots (1A) therein. The chuck (2) is provided with protuberances or lugs (2A) that fit in the helical slots (1A), causing the chuck (2) to rotate as it longitudinally slides in the barrel (1). Note that in FIG. 1, a rear helical slot (1A) of the barrel (1) and a front of the lugs of the chuck (2) are shown, hence they appear oppositely directed.

In order to launch the RAF with a forward velocity, the launcher (L) includes a propulsion mechanism, preferably in the form of a means for propelling the chuck (2), including a RAF connected thereto, forwardly through the barrel (1). This propulsion mechanism is preferably one or more metal or rubber extension springs (4). The springs (4) may be located in the helical grooves (1A) in the barrel (1). The springs (4) may be attached to the chuck (2) through pins (2C), and to the barrel (1) through similar pins attached to an inner barrel cap (5). In one embodiment, an outer barrel cap (6) is threaded to lock the inner barrel cap (5) in place and to secure the front of the barrel (1). It is noted, however, that other means may be provided for propelling the chuck (2). Such means might comprise a "bow" type propulsion mechanism where the chuck (2) is pulled rearwardy against a flexing or extensing member which, when released, pulls the chuck (2) forwardly, compressed air or other gas (such as from a cartridge or pump, piston or the like).

Figure 4:
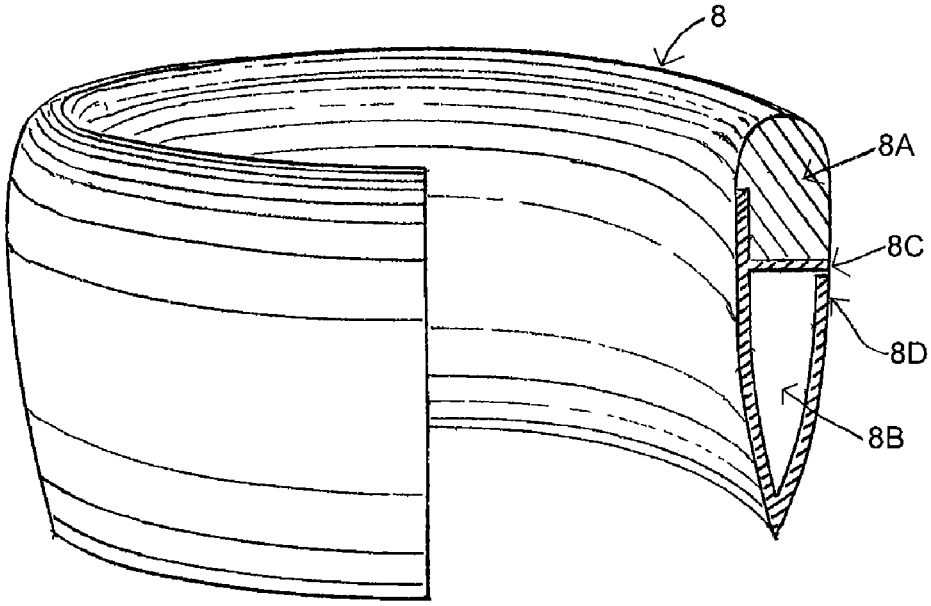
FIG. 4 is a cross-sectional view of the launcher of FIG. 1 taken along section line A-A therein.

Additional details of the launcher (L) will be appreciated when considering the ring airfoil (8) illustrated in FIG. 4. The ring airfoil (8) of the invention has particular utility to the launcher (L), though the ring airfoil (8) might be used with other launchers.

The RAF (8) preferably has the same in aerodynamic envelope and weight distribution to RAFs known to the art for proper flight characteristics of toy and sporting ring airfoils. As illustrated in FIG. 4, the RAF (8) comprises a body having an interior and an exterior. Preferably, the body comprises a head section (8A) and a tail section (8B) which are connected to one another. Both the head section (8A) and the tail section (8B) have a front and a rear and an inner surface and an outer/exterior surface. The tail section (8B) is located at the rear of the head section (8A), the two sections generally connected together at a join (8C). The head section (8A) and tail section (8B) are generally annular, each defining a central passage there through, whereby the RAF (8) defines a central passage.

The RAF (8) may be constructed of various materials. In one embodiment, the head section (8A) may be made of a soft rubber or foam to tailor impact characteristics, while the tail section (8B) may be constructed of thin sections of a stiffer plastic (or similar material) to facilitate loading and firing operations in the launcher of this application. In other embodiments, the RAF (8) might be configured as a single member/material.

As illustrated, in a preferred embodiment, the RAF (8) is configured to be engaged by a RAF engaging member of the launcher (L), as detailed below. In one embodiment, the RAF (8) is thus configured to define at least one groove or slot for accepting one or more engaging members. Preferably, this at least one groove or slot is located at the point of maximum exterior diameter of the RAF (8), at the join (8C).

In one embodiment, the tail section (8B) is hollow and an exterior or outer portion thereof is at least partially defined by a moveable flap or detent (8D). In a preferred embodiment, the flap (8D) extends forwardly from the tail or rear-most portion of the RAF (8) towards the head section (8A). However, a front or proximal end of the flap (8D) is preferably freely movable, such by not being connected to at the join (8C). In one embodiment, there is a small gap between the join (8C) and the proximal end of the flap (8D) and the flap is configured to flex or move. This structure provides two preferred characteristics: (1) the tail portion (8B) can be made light so that the center of gravity of the RAF can be coincident with the center of pressure of the RAF in flight, when considering the mass of the head section (8A) (based upon a density and size of the head section—wherein the head section may have a first density greater than a second density of the tail section); and (2) the tail section's outer surface can maintain a smooth low drag configuration in flight, but the flap (8D) thereof can be temporarily flexed, bent or otherwise moved inwardly at the join (8C) when a force is applied thereto.

As detailed below, when the proximal or free end of the flap (8D) of the tail section (8B) is moved inwardly, a groove or channel is created on the outer circumference of the RAF (8) (and when the flap (8D) extends around the entire periphery of the RAF (8), the resulting groove is annular as well). This permits a RAF engaging member of the launcher (L) (and specifically the chuck), to engage the RAF (8).

In a preferred embodiment, the launcher (L) is configured as a breech-loading launcher. In this configuration, the chuck (2) preferably has a first, front or "muzzle" end that generally faces the muzzle end of the barrel (1), and an opposing second, rear or "breech" end. The chuck (2) is configured to receive ring airfoils delivered thereto at its rear or breech end, and ring airfoils are launched off of the front end of the chuck.

In addition, the launcher (L) is preferably configured to maintain a ring airfoil to the chuck (2) for launching. The chuck (2) is preferably configured to receive at least one RAF. In one embodiment, the chuck (2) is generally annular in shape, having an interior and an exterior, as best illustrated in FIG. 3. The interior is configured to receive at least a portion of a RAF therein, as illustrated in FIG. 2.

In one embodiment, the chuck (2) includes means for engaging a RAF to selectively maintain it in position in the chuck (2). In one embodiment, the chuck (2) is fitted with at least one RAF catch (2B) which extends inwardly at a rear portion thereof. As best illustrated in FIG. 3, the chuck (2) includes four catches (2B) spaced around the chuck (2), each catch preferably moveable from an extended position to a retracted position. In the retracted position, they have a reduced profile, such as for passing past the head section (8A) of a RAF during loading. In the extended position, they have an increased profile for positioning in a portion of a RAF. As illustrated, the catches (2B) may have a base section and a flexible tab which has a similar configuration to the tail section of the RAF (where the tab is connected at one end to the base portion of the catch and has a free end which may move relative to the base section).

Figure 2:
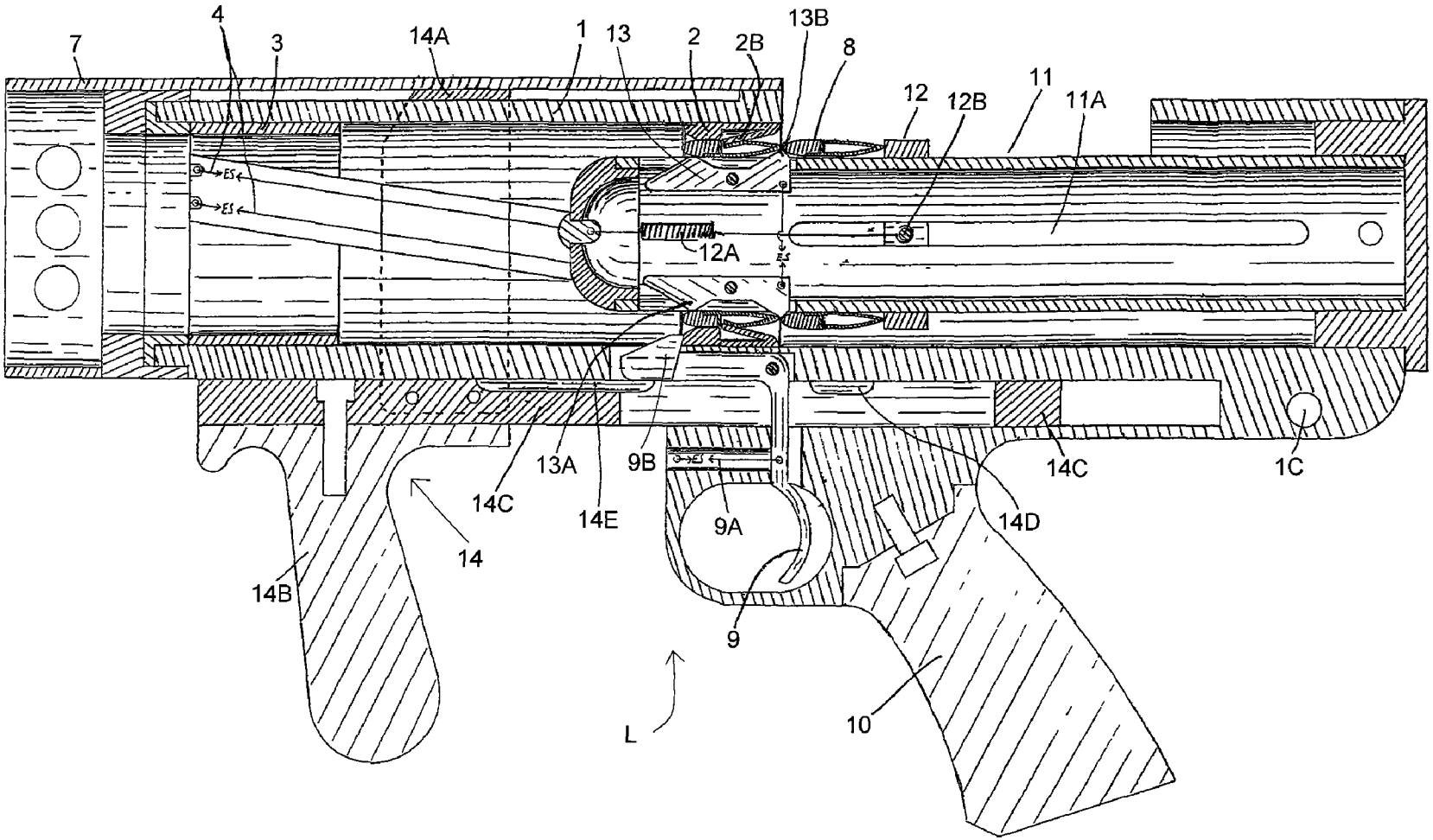
FIG. 2 is a full section drawing illustrating the ring airfoil launcher illustrated in FIG. 1 in a cocked and loaded state, but where a cocking lever has not yet been fully pushed forward.
Figure 3:
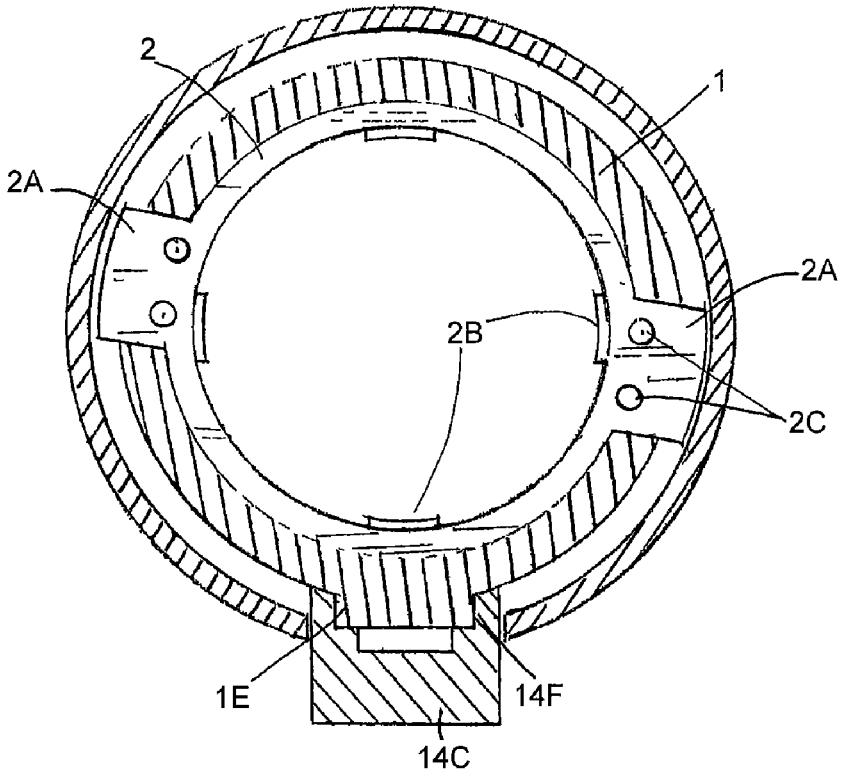
FIG. 3 is a partial section drawing which illustrates a ring airfoil projectile (RAF) in accordance with an embodiment of the invention.

FIG. 2 illustrates how the catches (2B) may engage a RAF to maintain it in position relative to the chuck (2). When a RAF is moved forwardly over the rear end of the chuck (2) onto the chuck, the solid head section (8A) compresses the tab portion of the catches (2B) to their inward position, permitting the RAF to pass by the catches (2B). However, once the head section (8A) has passed the catches (2B), the tab portions may move to their extended position. In particular, the tab portions of the catches (2B) press the outer portion (8D) of the tail section (8B) of the RAF inwardly. The catches (2B) then extended into the groove or channel in the tail section (8B) of the RAF. The inter-engagement of the catches (2B) with the RAF strongly locks the RAF to the chuck (2), preventing any rearward movement of the RAF relative to the chuck (2). In particular, rearward movement of the RAF is countered by interference of the chuck catches (2B) with the RAF support flange (8C). This ensures that the RAF is maintained on the chuck (2) under the forward propelling forces applied to the chuck (2) during launch. Further, forward movement of the RAF relative to the chuck (2) is inhibited by the inward force applied by the catches (2B) to the RAF. This will keep the RAF in position through most adverse accelerations during usage.

Importantly, however, this engagement mechanism still permits the RAF to be released from the chuck (2) at the muzzle end of the barrel (1). In particular, when the chuck (2) decelerates upon its impact with the forward buffer (3) at the front of the barrel, the forward propelling force upon the RAF is sufficiently great to cause the outer portion (8D) to move past the catches (2B). The rearward locking of the RAF to the chuck (2) is the basis of control of the RAF during launch, facilitating the following firing action. As the chuck (2) is urged forward on firing, a RAF properly placed on it will be constrained to move with the chuck and attain both longitudinal and rotational velocities needed for proper flight. When the chuck (2) has reached the full forward limit of its travel, its leading edge abuts the annular buffer (3) provided at the muzzle of the launcher (L). With the chuck (2) rapidly decelerated, the RAF will detach itself from the chuck (2), moving forward on its own inertia, and exit the launcher.

Preferably, the launcher (L) includes a user-operable firing mechanism. This mechanism is configured to permit a user to selectively control the propulsion of the chuck (2) and a RAF thereon. To fire the launcher (L), a trigger (9) is provided. In one embodiment, the trigger (9) is associated with a pistol-grip assembly (10). The firing mechanism includes a means for biasing the trigger to an "unfiring" position (to rotate the trigger clockwise in FIGS. 1 and 2). In one embodiment, this means comprises at least one trigger spring (9A).

The trigger (9) is configured to selectively control the position of the chuck (2). In a preferred embodiment, the trigger (9) controls a chuck-engaging sear (9B). The trigger (9) and sear (9B) may be a one-piece assembly, as illustrated. The sear (9B) extends into the barrel (1) and is configured to selectively block or engage a leading edge of at least a portion of the chuck (2) when the chuck is retracted past the sear, as shown in FIG. 2. In this position, the sear (9B) prevents forward movement of the chuck (2), locking the chuck in a cocked position. When a user pulls the trigger (9) rearwardly, overcoming the biasing force applied by the spring (9A), the sear (9B) is moved downwardly so that it no longer blocks the chuck (2), then permitting the chuck to move forward, firing the launcher (L).

Preferably, the launcher (L) is hand-cocked for firing by use of a cocking mechanism. The cocking mechanism preferably includes a cocking fixture (14). In one embodiment, the cocking fixture (14) is composed of three parts: a cocking ring (14A); a cocking handle (14B); and a cocking bar (14C). In one embodiment, these elements are connected to one another, such as by being a single member, and thus move with one another. In this regard, the cocking fixture (14A) is preferably longitudinally slideable within the barrel (1) of the launcher (L) and is confined to this movement by the cocking ring (14A) surrounding the barrel (1) and by a tongue-in-groove railing formed between a slot (14F) in the cocking bar (14C) and a longitudinal ridge (1E) formed on a lower side of the barrel (1). The cocking fixture (14) may move between a forward-most position, at which the cocking ring (14A) is safely forward of the forward-most travel of the chuck (2), and a rearward-most position at which a rear of the cocking bar (14C) abuts a stop (1F) in the barrel/frame (1).

When the cocking fixture (14) is moved rearwardly, it engages the chuck (2), thus moving the chuck rearwardly as well towards its cocked position at the breech end of the barrel (1). At its rearward-most position, the chuck (2) is retracted sufficiently to override the sear (9B) and allow the chuck catches (2B) to snap behind the RAF being loaded onto the chuck (2).

The means by which the cocking fixture (14) retracts the chuck (2) against the force of the propelling springs (4) is as follows. A user grasps the cocking handle (14B) and draws it rearwardly. This drawing force is transmitted through to the cocking bar (14C) to the cocking ring (14A), causing it to move rearwardly. After a short distance of rearward travel, such as approximately 0.25 inch, a rear surface of the cocking ring (14A) contacts the outer front surfaces of lugs (2A) of the chuck (2). The cocking ring (14A) then forces the chuck (2) to move to the rear with it. Upon sufficient rearward movement, a recess (14D) in the cocking bar (14B) aligns with the sear (9B), permitting the sear to move upwardly into the locked position as illustrated in FIG. 2. At this time, the sear (9B) is moved into a locking position but is blocked from being moved downwardly by action of the trigger (9), thus preventing firing of the launcher (L). This is a safety feature which denies firing of the launcher (L) when the cocking fixture (14) would be struck by the forward driving chuck (2). Once the chuck (2) is drawn sufficiently rearwardly, the sear (9B) moves upwardly and blocks the leading or front portion of the chuck (2). Again, at that time, the launcher (L) still cannot be fired because the sear (9B) cannot move downwardly. The user then must move the cocking fixture (14) forwardly to a firing position in which it is clear of the chuck (2) when the chuck (2) is propelled forwardly. At that time, another recess (14E) in the cocking bar (14E) aligns the sear (9B), permitting the sear to move downwardly.

FIG. 2 illustrates the cocking fixture (14) in an intermediate position where the sear (9B) cannot be moved downward (i.e. the trigger cannot be pulled and the chuck cannot be released). FIG. 1 illustrates the full forward location of the cocking bar (14A) in which the recess (14D) (illustration using hidden lines) is aligned with the sear (9B), allowing the trigger (9) to be pulled to retract the sear (9B) and fire the launcher (L).

In a preferred embodiment the launcher (L) is configured with a RAF self-loading mechanism. This allows the launcher (L) to have a semi-automatic firing feature. This loading mechanism causes RAFs to be automatically transferred to the chuck (2) for successive firing each time the chuck (2) is pulled to its rear, cocked location.

FIGS. 1 and 2 illustrate one embodiment of a self-loading mechanism. In this embodiment, RAFs are delivered to the retracting chuck (2) by a direct transfer method from a linear magazine. The magazine comprises a body or member (11) which is fitted with a follower (12) shaped as a simple ring, slideable along the outside circumference of the member. The magazine includes a longitudinal slot (11A). The member (11) is preferably hollow. The magazine includes a means for drawing the follower (12) forwardly. In one embodiment, this means comprises at least one follower spring (12A) located in the member (11). The at least one following spring (12A) urges the follower (12) forwardly through a connecting rod (12B) which is attached to the spring and to the follower through the longitudinal slot (11A). At a forward end of the magazine are two escapement levers (13) oriented to face the top and bottom of the body (11) (see FIG. 2). These levers (13) are configured to pivot about a generally central pinion between a forward tooth (13A) and a rear tooth (13B). Means are provided for biasing the levers (13) to a loading position in which a rear portion of the levers (13), including the rear teeth (13B) are pulled inwardly. This means may comprise at least one extension spring (ES) extending between the two levers (13).

The magazine is configured to deliver RAFs one at a time to the chuck (2) in a simple manner, free from jams, as will now be appreciated. As the chuck (2) is drawn past its cocking location by the user's rearward movement of the cocking mechanism (14), the sear (9B) moves upwardly in front of the chuck (2). Simultaneously, the catches (2B) of the chuck (2) spring outward as the chuck rides over the RAF in the service position (the RAF engaged between the forward teeth (13A) and rear teeth (13B) of the escapement levers (13)). The RAF is held in the service position by the forward urging of follower (12) under the force of the magazine spring (12A) (which is made to be comfortably stronger than the rearward force engendered by the sliding of the outwardly flexing chuck catches over the RAF). The RAF is squeezed somewhat inward as the catches (2B) of the chuck (2) ride over it, thus enhancing friction between the magazine member (11) and the RAF, keeping the RAF from moving (friction between the magazine member (11) and the inner surface of the RAF may be increased by adding forward facing serrations to the outer surface of the magazine member at the escapement location). As indicated above, when the chuck (2) moves sufficiently rearward past the head section (8A) of the RAF, the catches (2B) spring outwardly to their extended position, engaging the RAF as previously described. This contact of the catches (8B) with the RAF holds the served RAF to the chuck (2) against normal forward forces such as gravity and minor bumps. As the user allows the cocking mechanism (14) to relax forwardly, the chuck driving springs (4) urge the loaded chuck (2) forward a until the sear (9B) halts further forward movement. At this time the RAF is seated to the chuck and has smoothly overridden the front teeth (13A) of the magazine escapement levers (13). The next RAF in the magazine cannot move forward because the front teeth (13A) of the escapement levers (13) are pressed inward by the served RAF, as shown in FIG. 2, thus maintaining the rear escapement teeth (13B) open to impede the forward movement of the next RAF. When the trigger (9) is pulled, the sear (9B) moves down and the chuck (2) is propelled forwardly, carrying the served RAF forward. At this time, the escapement extension spring ES is able pull the rear teeth (13B) inwardly, allowing the next RAF to access the service position described above.

In one embodiment, the magazine is fitted at its rear with a simple magazine catch (15) (such as comprising a pin which extends outwardly from the magazine member (11) for engagement with an "L" shaped slot in the launcher body). This catch (15) may be simply and effectively actuated by twisting or rotating the magazine member (11) relative to the launcher (L) to lock and/or release it there from. To place the magazine in the launcher (L), the magazine is inserted into the rear of the launcher (L) and pushed forward until a contact circumference/end of the magazine is stopped. The magazine is then twisted to engage the catch (15).

To charge the magazine, the magazine is removed from the launcher (L). A user then slides RAFs one at a time onto the front end of the magazine member (11) over the escapement levers (13). As each RAF passes, the front teeth (13A) are pushed inwardly, allowing the RAF to slip over them, and then as the leading edge of the RAF passes the front teeth and the trailing edge contacts the rear teeth (13B) of the levers (13), the rear teeth are compressed inwardly, allowing the RAF to pass the levers. By this method a plurality of RAFs can be loaded onto the member (11) behind the levers (13). Once loaded, the follower (12) urges the RAFs forwardly. At this time, the rear teeth (13B) close inwardly under the bias of the spring (ES), allowing the front RAF to be pushed over the rear teeth (13B) until it hits the front teeth (13A) of the levers (13). At that time, the front RAF levers (13) pivot as the RAF contacts the front teeth (13A), ill squeezing them inwardly. This pivots the levers (13) so that the rear teeth (13B) move outwardly, preventing the second or next RAF from being moved forwardly. At this time, the first RAF is located in a position where it can be served or delivered to the chuck (2) of the launcher (L). Since the forward teeth (13A) of the escapement lever (13) press outward against the inner radius of the RAF, the front RAF is held in place by friction.

In one embodiment, a recess or slot (1D) may be formed in the launcher body. This recess (1D) permits the user to view the action of the magazine follower (12) as the mechanism is actuated. The greater purpose of this recess or slot (1D) is to allow the operator to charge the chuck (2) by hand should the magazine be lost or damaged. In one embodiment, the launcher (L) does not include a magazine safety for the purpose of permitting the launcher to shoot a single RAF. Another purpose of the recess or slot (1D) is to allow hand loading of projectiles other than RAFs. A body of revolution such as a foam grenade having an appropriate circumferential groove to allow locking of the chuck catches (2B) thereto as described for the RAF, could be placed in the chuck by hand and launched (albeit to a lesser distance than attainable by the RAF).

As indicated above, in one embodiment, the launcher (L) includes a RAF loading or delivery mechanism, whereby at least two RAFs are delivered to the launcher (L) for launching in successive fashion (and preferably in a manner which does not require the user to manually load the launcher), preferably to the breech or rear end of the chuck. In the embodiment described above, such a mechanism comprised a linear-feeding magazine. However, the launcher (L) may utilize or be configured to work with other feeding or loading systems. Another such mechanism may comprise a rotary drum magazine, such as illustrated in FIG. 5.

In a preferred embodiment, the rotary magazine defines at least two ring airfoil mounts. The mounts are rotatable about an axis so that they may be aligned with the chuck for transfer of a ring airfoil on the mount to the chuck. In the preferred embodiment, the mounts rotate about a second axis which is oriented transversely to the axis of the barrel (as compared to the linear magazine detailed above where the axis of movement is along the magazine and aligned with the axis of the barrel). As illustrated, when the first axis of the barrel is generally horizontal, the second axis is generally vertically extending.

It is noted that it is possible to orient the rotary magazine behind the breech so that the axis of rotation thereof is parallel to the barrel (and thus, for example, aligned with the barrel), while still maintaining the preferred breech-loading configuration of the launcher. The particular transverse orientation of a rotary magazine described here is considered more advantageous (to a parallel oriented rotary magazine) for at least the reasons that the trigger mechanism remains simple and the magazine is in a position where it does not interfere with the non-shooting hand of the user as the user engages the cocking mechanism.

Figure 5:
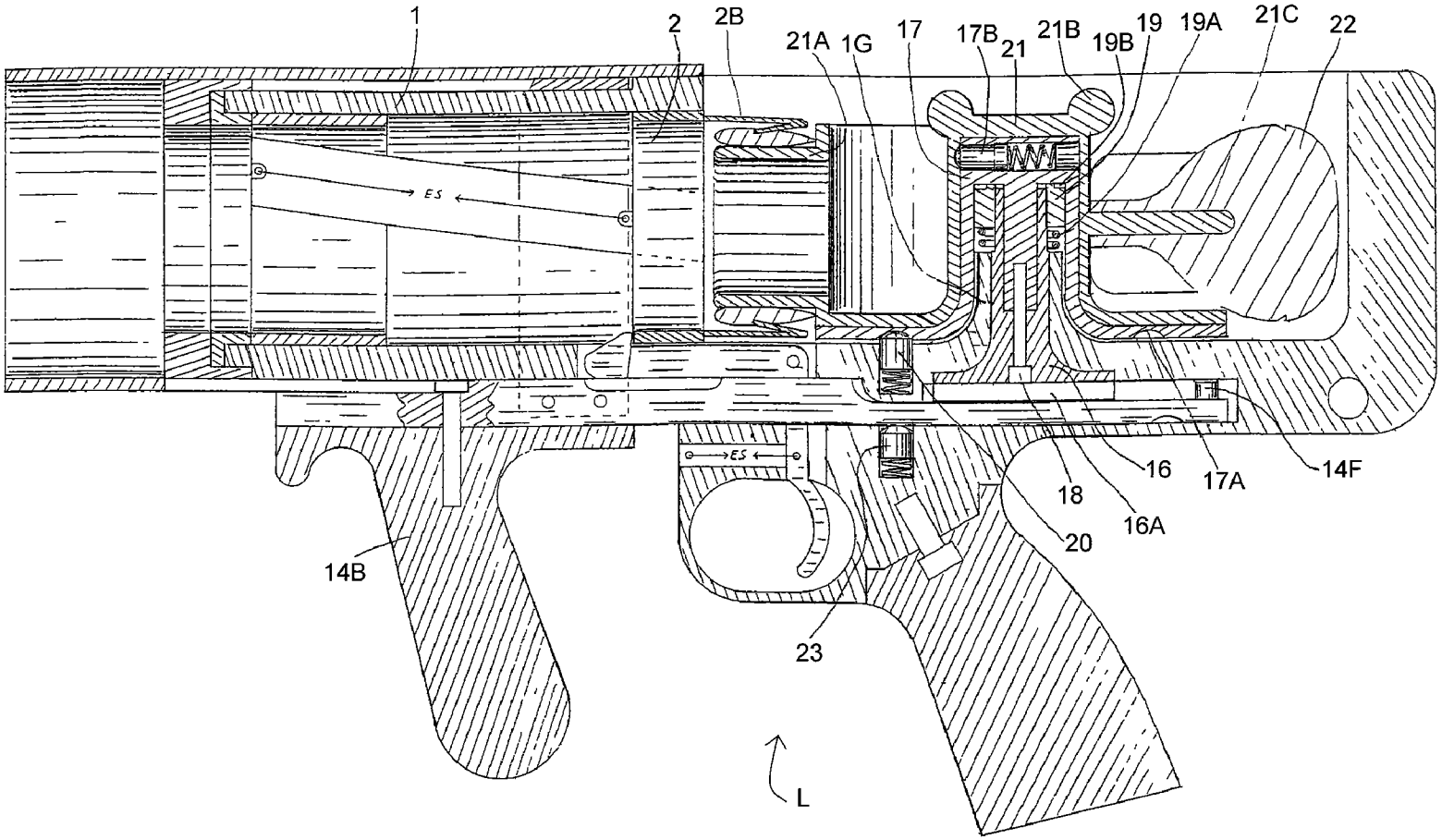
FIG. 5 is a partial section drawing of a ring airfoil launcher in accordance with a second embodiment of the invention.

Referring to FIG. 5, in one embodiment, the rotary magazine mechanism comprises a removable radial magazine (21) having a plurality of indexed RAF serving stations or mounts (21A). Each mount (21A) is preferably configured to receive and support for delivery to the chuck (2) of the launcher (L), at least one RAF. In one embodiment, each mount (21) extends along an axis which is positioned in the same plane as the first axis of the barrel (1), whereby when the mount (21) is aligned with the barrel, the axis of the mount and barrel align.

The magazine mechanism also comprises a ratcheted spindle. In one embodiment, the spindle comprises a lower spindle (16) with a cam plate (16A), and an upper spindle (17) which is adapted to securely hold the magazine (21). A plunger (17B) holds the magazine on the upper spindle (17) and a hexagonal fit (not shown) between the magazine and the upper spindle rotationally locks the magazine to the upper spindle. A bolt or other fastener (18), which turns with the upper spindle (17), preferably mounts the upper and lower spindles on a spindle base (1G). Above the spindle base (1G) is a plunger type ratchet (19) and spring (19A). The ratchet (19) is rotationally locked to the lower spindle (16) by a sliding hexagonal fit (not shown) which allows an up-down movement of the ratchet.

Teeth (19B) located on the upper surface of the ratchet (19) are forced by upward pressure of a ratchet spring to engage similar teeth located at a bottom of the upper spindle (17). The teeth are made so that a high torque applied from the lower spindle (16) in a preferred direction (e.g. clockwise) will be transferred to the upper spindle (19). A torque of the opposite direction will cause the teeth to more easily slip downward against the force of spring (19A), thus the torque applied to the upper spindle will be much lower in this direction. The upper spindle (17) is fitted with index holes (17A), each one positioned to precisely locate each loading station (17B). The frame is fitted with a plunger (20) which is designed to fit into the index holes (17A) when corresponding loading stations are located optimally for loading. The contact between the plunger (20) and the index holes (17A) is sufficient to maintain the upper spindle (17) at each index location with an intermediate torque.

It can be seen that if the lower spindle (16) applies a torque in the preferred direction, the teeth of the ratchet (19) will be able to overcome the resistance of the intermediate torque of the plunger (20), and the upper spindle (17) will rotate. However, when the lower spindle (16) is rotated in the non-preferred direction, the plunger (20) will provide enough resistance to cause the teeth of the ratchet (19) to be forced down and slip over the back of the teeth of the upper spindle (17), and it will not rotate in the non-preferred direction. The lower spindle's cam plate (16A) is fitted with a curved groove which engages a lug (14F) fixed to the end of the cocking bar assembly (14). As the cocking bar assembly (14) is pulled back by the user through force on cocking handle (14B), the lug (14F) is caused to move rearward and linearly traverse the curved groove (16A). This forces the lower spindle (16) to rotate in the preferred direction as the lug (14F) traverses the curved groove (16A). As the cocking bar assembly (14) is pushed forward from the rear location shown in FIG. 4, the lug (14F) causes the lower spindle (16) to rotate in the non-preferred direction. Thus, by pumping the cocking handle (14B) back and forth, it can be seen that the upper spindle (17) will be advanced by one index location.

The mechanism described above is but one mechanism for translating the back and forth motions of the cocking handle (14B) to effect rotation of the rotary magazine by a single position. However, other mechanisms might be utilized. The purpose of the mechanism is to serve a loaded RAF station to the shooting mechanism just before it is ready to engage it. As inferred from the mechanism of FIG. 5, a new station (21A), will be rotated into position and indexed to the center of the barrel just before the teeth (2A) of the chuck (2) move over it. Further rearward force on the cocking bar (14C) will then cause the chuck catches (2B) to slide over a RAF, if one has been placed on active serving station, as shown in FIG. 5. The catches (2B) will snap over the RAF as detailed above, and the launcher (L) will be ready to shoot as shown in FIG. 5.

As also illustrated in FIG. 5, the invention may include one or more handle knobs (21B) on the replaceable magazine to assist in its removal and handling. In addition, one or more of the mounts of the magazine (21) may be configured to receive other projectiles. For example, one such mount may comprise a pin (21C) for receiving a grenade-style projectile (22) or other bodies of revolution. Also, a plunger (23) may be included in the barrel (1) to selectively lock the cocking bar (14C) in the forward position.

The launcher (L) may have other features and configurations. For example, referring to FIG. 1, in one embodiment, a shroud (7) is located over the barrel (1) to protect the user from scrapes due to inadvertent placement of the non-shooting hand on the barrel. The shroud (7) may be a simple cylindrical enclosure that slips over the barrel (1), such as from the front, and pinned or otherwise secured in position. The front of the shroud (7) may be fitted with "compensator" holes for realistic appearance.

The launcher (L) may also have an attachment hole (1C) at its lower rear or other location for the attachment of a removable buttstock (not shown). Thus, the device can be used either in rifle or pistol configuration.

The launcher may be constructed from various materials and have other variations. For example, while the launcher might be constructed primarily of plastic to reduce its weight as a toy, it could be constructed primarily from metal.

Also, the launcher might be configured to accept more than one magazine (such as rotary magazines in a turnstile configuration). The launcher might have various external shapes and appearances without varying from the principles of the invention.

As indicated, the sear might have a two-piece construction and have other forms than as detailed above. For example, the sear might be made in a hemi-spherical "wishbone" shape having a base portion which pivots and having a pairs of arms which extend upwardly around the chuck for selectively engaging the lugs of the chuck. As the chuck is moved to the cocked position, a cam or similar mechanism may cause the arms to follow the chuck rearwardly. A portion of the trigger may keep the arms in an upright position, thus blocking the lugs of the chuck. When the trigger is pulled, the arms are released, whereby the propulsion springs may cause the arms to rotate forward, releasing the chuck.

It will be appreciated with that while the launcher may be used to launch ring airfoils for toy and sporting purposes, the ring airfoils could be launched for a variety of purposes, whether in games, for entertainment or otherwise.

As also indicated, it is possible for the launcher to be used to launch projectiles other than ring airfoils. The launcher might also be used to launch ring airfoils having configurations which vary from that described and illustrated herein.

The launcher might have various sizes. For example, the length of the barrel might vary greatly. As also indicated, the launcher might be configured to be short for use as a pistol-type device, or long as in a rifle-type configuration.

The diameter of the ring airfoils used with the launcher, and thus the size of the launcher's chuck and barrel, may vary. For example, the ring airfoils might have a diameter of about 1-3 inches or smaller, or as large as 4-8 inches or more. In such event, the launcher may be configured with components permitting use of such sized ring airfoils.

The invention has numerous benefits. One benefit of the invention is a launcher which is configured to receive at least one magazine containing or supporting at least two ring airfoils, whereby the launcher may launch successive ring airfoils without intervening manual reloading of the launcher.

A particular advantage of the invention is the simple and effective launch and load mechanism for the ring airfoils which increase the reliability of the launcher, including by reducing the risk of jamming. In addition, the configuration of the launcher and the magazines are simple.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A ring airfoil launcher comprising:

a barrel defining a launch passage, said barrel having a first breech end and an opposing second muzzle end and an interior surface;

a chuck constrained in said barrel and movable back and forth within said passage of said barrel between a firing position at said breech end of said barrel and a fired position at said muzzle end of said barrel, said chuck having an outer surface facing said interior surface of said barrel and having a front end facing towards said muzzle end of said barrel and an opposing rear end, said chuck when in said firing position configured to receive a ring airfoil for launching at said rear end thereof and in said fired position configured to launch said ring airfoil from said front end thereof, whereby said ring airfoil is loaded into said chuck from a position rear of said chuck and is then launched forwardly from said front of said chuck;

at least one ring airfoil engaging member configured to connect a ring airfoil associated with said chuck for launching thereof, said at least one ring airfoil engaging member configured to prevent rearward movement of a ring airfoil mounted on said chuck during propulsion of said chuck during launch; and a propulsion mechanism configured to propel said chuck having a ring airfoil mounted thereto from said firing position at said breech end of said barrel to said fired position at said muzzle end, whereby said ring airfoil is projected from said chuck from said front end thereof and out of said muzzle end of said barrel.

2. The ring airfoil launcher in accordance with claim 1 further comprising a ring airfoil loading mechanism, said mechanism configured to successively deliver at least two ring airfoils to said chuck.

3. The ring airfoil launcher in accordance with claim 1 wherein said at least one ring airfoil engaging member comprises at least one catch moveable from a retracted position to an extended position, said catch in said extended position configured to engage a ring airfoil.

4. The ring airfoil launcher in accordance with claim 3 wherein said chuck is generally annular in shape, having an interior and an exterior, said interior configured to receive at least a portion of a ring airfoil therein, and wherein said at least one catch extends inwardly from said chuck towards said ring airfoil.

5. The ring airfoil launcher in accordance with claim 1 wherein said propulsion mechanism is selected from the group consisting of: a metal spring, a rubber spring, compressed gas, a piston and a bow.

6. The ring airfoil launcher in accordance with claim 1 wherein said chuck is configured to rotate as it moves through said barrel.

7. The ring airfoil launcher in accordance with claim 1 further comprising a cocking mechanism, said cocking mechanism configured to move said chuck along said barrel rearwardly from said fired position back to said firing position.

8. The ring airfoil launcher in accordance with claim 1 further comprising a firing mechanism configured to receive user input to cause said propulsion mechanism to propel said chuck.

9. The ring airfoil launcher in accordance with claim 8 wherein said firing mechanism comprises a trigger configured to move a sear, said sear moveable between an extended position in which it maintains said chuck in said firing position and a retracted position when said trigger is pulled, said chuck is permitted to move forwardly when said sear is moved to said retracted position.

10. The ring airfoil in accordance with claim 1 wherein said launcher is configured to receive a ring airfoil magazine at said breech end of said barrel.

11. A ring airfoil launcher comprising:

a barrel defining a launch passage along a first axis, said barrel having a first breech end and an opposing second muzzle end;

a chuck movably mounted in said passage of said barrel along said first axis, said chuck having an outer surface and having a front end facing towards said muzzle end of said barrel and an opposing rear end, said chuck configured to receive a ring airfoil for launching at said rear end thereof and to launch said ring airfoil from said front end thereof;

at least one ring airfoil engaging member located on said chuck, said at least one ring airfoil engaging member configured to engage a ring airfoil associated with said chuck for launching thereof, said at least one ring airfoil engaging member configured to prevent rearward movement of a ring airfoil mounted on said chuck during propulsion of said chuck during launch;

a propulsion mechanism configured to propel said chuck having a ring airfoil connected thereto from a first position in which said chuck is located at said breech end of said barrel towards second muzzle end, whereby said ring airfoil is projected from said chuck from said front end thereof and out of said muzzle end of said barrel; and a ring airfoil loading mechanism, said loading mechanism comprising a rotary magazine defining at least two ring airfoil mounts.

12. The ring airfoil launcher in accordance with claim 11 further comprising a firing mechanism configured to receive user input to cause said propulsion mechanism to propel said chuck.

13. The ring airfoil launcher in accordance with claim 11 wherein said magazine is configured to rotate about a second axis generally transverse to said first axis to positions in which a ring airfoil located on said mounts is aligned with said chuck for loading to said chuck.

14. The ring airfoil launcher in accordance with claim 13 wherein said magazine is removably mounted to a spindle which is configured to rotate about said second axis.

15. The ring airfoil launcher in accordance with claim 11 wherein said loading mechanism defines a plurality of positions corresponding to said mounts and wherein said launcher further comprises a cocking mechanism, said cocking mechanism configured to move said chuck along said barrel rearwardly towards said breech end to said first position and configured to move said magazine to successive positions.

16. The ring airfoil launcher in accordance with claim 11 wherein said magazine is located at said breech end of said barrel.

17. The ring airfoil launcher in accordance with claim 11 wherein said ring airfoil mounts comprise a receiver extending along a third axis positioned in the same plane as said first axis.

18. The ring airfoil launcher in accordance with claim 11 wherein said at least one ring airfoil engaging member located on said chuck is configured to engage a ring airfoil mounted on a mount of said magazine when aligned with said chuck.

* * * * *